US010355339B2

(12) United States Patent
Jin et al.

(10) Patent No.: US 10,355,339 B2
(45) Date of Patent: Jul. 16, 2019

(54) TUNABLE ANTENNA WITH SLOT-BASED PARASITIC ELEMENT

(71) Applicant: Apple Inc., Cupertino, CA (US)

(72) Inventors: Nanbo Jin, Milpitas, CA (US); Yuehui Ouyang, Sunnyvale, CA (US); Yijun Zhou, Sunnyvale, CA (US); Enrique Ayala Vazquez, Watsonville, CA (US); Anand Lakshmanan, San Jose, CA (US); Robert W. Schlub, Cupertino, CA (US); Mattia Pascolini, San Francisco, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 565 days.

(21) Appl. No.: 15/085,095

(22) Filed: Mar. 30, 2016

(65) Prior Publication Data

US 2016/0211570 A1 Jul. 21, 2016

Related U.S. Application Data

(63) Continuation of application No. 13/846,471, filed on Mar. 18, 2013, now Pat. No. 9,331,397.

(51) Int. Cl.
*H01Q 1/24* (2006.01)
*H01Q 5/10* (2015.01)
(Continued)

(52) U.S. Cl.
CPC ..... *H01Q 1/24* (2013.01); *H01Q 1/243* (2013.01); *H01Q 5/10* (2015.01); *H01Q 5/15* (2015.01);
(Continued)

(58) Field of Classification Search
CPC ..... H01Q 1/243; H01Q 5/378; H01Q 9/42
See application file for complete search history.

(56) References Cited

U.S. PATENT DOCUMENTS 4,518,965 A 5/1985 Hidaka
5,048,118 A 9/1991 Brooks et al.
(Continued)

FOREIGN PATENT DOCUMENTS

CN 102110873 6/2011
CN 102683861 9/2012
(Continued)

*Primary Examiner* — Ricardo I Magallanes
(74) *Attorney, Agent, or Firm* — Treyz Law Group, P.C.; G. Victor Treyz; Michael H. Lyons

(57) ABSTRACT

Electronic devices may be provided that contain wireless communications circuitry. The wireless communications circuitry may include radio-frequency transceiver circuitry and antenna structures. The antenna structures may form a dual arm inverted-F antenna. The antenna may have a resonating element formed from portions of a peripheral conductive electronic device housing member and may have an antenna ground that is separated from the antenna resonating element by a gap. A short circuit path may bridge the gap. An antenna feed may be coupled across the gap in parallel with the short circuit path. Low band tuning may be provided using an adjustable inductor that bridges the gap. The antenna may have a slot-based parasitic antenna resonating element with a slot formed between portions of the peripheral conductive electronic device housing member and the antenna ground. An adjustable capacitor may bridge the slot to provide high band tuning.

19 Claims, 8 Drawing Sheets

(51) Int. Cl.

| | |
|---|---|
| ***H01Q 5/15*** | (2015.01) |
| ***H01Q 9/06*** | (2006.01) |
| ***H01Q 13/10*** | (2006.01) |
| ***H01Q 21/28*** | (2006.01) |
| ***H01Q 5/314*** | (2015.01) |

(52) U.S. Cl.

CPC ..... *H01Q 5/314* (2015.01); *H01Q 9/06* (2013.01); *H01Q 21/28* (2013.01); *H01Q 13/10* (2013.01)

(56) References Cited

U.S. PATENT DOCUMENTS 5,768,691 A 6/1998 Kangas et al.
5,832,372 A 11/1998 Clelland et al.
6,034,636 A 3/2000 Saitoh
6,218,997 B1 4/2001 Lindenmeier et al.
6,317,094 B1 11/2001 Wu et al.
6,414,641 B1 7/2002 Carlson et al.
6,423,915 B1 7/2002 Winter
6,498,586 B2 12/2002 Pankinaho
6,504,507 B2 1/2003 Geeraert
6,560,443 B1 5/2003 Vaisanen et al.
6,650,295 B2 11/2003 Ollikainen et al.
6,670,923 B1 12/2003 Kadambi et al.
6,714,162 B1 3/2004 Kadambi et al.
6,734,825 B1 5/2004 Guo et al.
6,762,723 B2 7/2004 Nallo et al.
6,762,729 B2 7/2004 Egashira
6,836,249 B2 12/2004 Kenoun et al.
6,917,335 B2 7/2005 Kadambi et al.
6,933,893 B2 8/2005 Rubindhteyn et al.
6,950,065 B2 9/2005 Ying et al.
6,970,137 B1 11/2005 Maslovski et al.
6,980,154 B2 12/2005 Vance et al.
7,043,285 B2 5/2006 Boyle
7,075,493 B2 7/2006 Azadegan et al.
7,079,079 B2 7/2006 Jo et al.
7,145,513 B1 12/2006 Cohen
7,164,387 B2 1/2007 Sievenpiper
7,183,982 B2 2/2007 Kadambi et al.
7,215,283 B2 5/2007 Boyle
7,250,910 B2 7/2007 Yoshikawa et al.
7,260,424 B2 8/2007 Schmidt
7,408,515 B2 8/2008 Leisten
7,439,911 B2 10/2008 Wang
7,551,142 B1 6/2009 Zhang et al.
7,595,759 B2 9/2009 Schlub et al.
7,612,725 B2 11/2009 Hill et al.
7,626,551 B2 12/2009 Chien et al.
7,671,804 B2 3/2010 Zhang et al.
7,768,462 B2 8/2010 Zhang et al.
7,808,438 B2 10/2010 Schlub et al.
7,812,774 B2 10/2010 Friman et al.
7,834,813 B2 11/2010 Cami et al.
7,843,396 B2 11/2010 Hill et al.
7,889,143 B2 2/2011 Milosavljevic et al.
7,893,883 B2 2/2011 Schlub et al.
7,898,485 B2 3/2011 Schlub et al.
7,924,226 B2 4/2011 Soler Castany et al.
7,924,231 B2 4/2011 Hill et al.
8,063,827 B2 11/2011 Hotta et al.
8,094,079 B2 1/2012 Schlub et al.
8,111,640 B2 2/2012 Knox
8,270,914 B2 9/2012 Pascolini et al.
8,350,761 B2 1/2013 Hill et al.
8,599,089 B2 12/2013 Bevelacqua et al.
8,610,629 B2 12/2013 Pascolini et al.
8,773,310 B2 7/2014 Shiu et al.
8,798,554 B2 8/2014 Darnell et al.
9,153,874 B2 10/2015 Ouyang et al.
9,331,397 B2 5/2016 Jin et al.
2003/0098812 A1 5/2003 Ying et al.
2003/0122721 A1 7/2003 Sievenpiper
2003/0222823 A1 12/2003 Flint et al.
2004/0140933 A1 7/2004 Shikata et al.
2004/0222926 A1 11/2004 Kontogeorgakis et al.
2004/0227674 A1 11/2004 Asano et al.
2004/0227678 A1 11/2004 Sievenpiper
2004/0257283 A1 12/2004 Asano et al.
2005/0007291 A1 1/2005 Fabrega-Sanchez et al.
2005/0151689 A1 7/2005 Vesterinen
2005/0270242 A1 12/2005 Qi et al.
2005/0280587 A1 12/2005 Svigelj et al.
2006/0055606 A1 3/2006 Boyle
2006/0097918 A1 5/2006 Oshiyama
2006/0178116 A1 8/2006 Qi et al.
2007/0008222 A1 1/2007 Wang et al.
2007/0222697 A1 9/2007 Caimi et al.
2008/0055164 A1 3/2008 Zhang et al.
2008/0150815 A1 6/2008 Nakahata et al.
2008/0165065 A1 7/2008 Hill et al.
2008/0218291 A1 9/2008 Zhu
2008/0238794 A1 10/2008 Pan et al.
2008/0253345 A1 10/2008 Sanguinetti
2008/0278379 A1 11/2008 Wang et al.
2008/0316115 A1 12/2008 Hill et al.
2009/0051604 A1 2/2009 Zhang
2009/0051611 A1 2/2009 Shamblin et al.
2009/0128428 A1 5/2009 Ishizuki et al.
2009/0153407 A1* 6/2009 Zhang ..... H01Q 1/243 343/702
2009/0180403 A1 7/2009 Tudosoiu
2009/0231215 A1 9/2009 Taura
2009/0322639 A1 12/2009 Lai
2010/0053002 A1 3/2010 Wojack et al.
2010/0085260 A1 4/2010 McKinzie et al.
2010/0231470 A1 9/2010 Lee et al.
2010/0238079 A1 9/2010 Ayatollahi et al.
2010/0253538 A1 10/2010 Smith
2010/0279734 A1 11/2010 Karkinen et al.
2010/0295737 A1 11/2010 Milosavljevic et al.
2011/0021139 A1 1/2011 Montgomery et al.
2011/0102290 A1 5/2011 Milosavljevic
2011/0112970 A1 5/2011 Yu
2011/0133995 A1 6/2011 Pascolini et al.
2011/0183721 A1 7/2011 Hill et al.
2011/0188552 A1 8/2011 Yoon et al.
2011/0193754 A1 8/2011 Schlub et al.
2011/0241949 A1 10/2011 Nickel et al.
2011/0250928 A1 10/2011 Schlub et al.
2011/0312393 A1 12/2011 Pulimi et al.
2011/0316751 A1 12/2011 Jarvis et al.
2012/0009983 A1* 1/2012 Mow ..... H01Q 1/243 455/575.7
2012/0046002 A1 2/2012 Hill
2012/0146865 A1 4/2012 Hayashi
2012/0112969 A1 5/2012 Caballero et al.
2012/0112970 A1 5/2012 Caballero et al.
2012/0169552 A1 7/2012 Lee et al.
2012/0176292 A1 7/2012 Hung et al.
2012/0229347 A1 9/2012 Jin et al.
2012/0231750 A1 9/2012 Jin et al.
2012/0235866 A1* 9/2012 Kim ..... H01Q 1/243 343/700 MS
2012/0262345 A1* 10/2012 Kim ..... H01Q 1/243 343/702
2012/0299785 A1 11/2012 Bevelacqua
2013/0050046 A1 2/2013 Jarvis et al.
2013/0102357 A1 4/2013 Vance
2013/0169490 A1 7/2013 Pascolini et al.
2013/0201067 A1 8/2013 Hu et al.
2014/0062815 A1 3/2014 Tsai et al.
2014/0266923 A1 9/2014 Zhou et al.
2014/0292598 A1 10/2014 Bevelacqua et al.
2014/0306857 A1 10/2014 Bevelacqua et al.
2014/0333495 A1 11/2014 Vazquez et al.
2014/0333496 A1 11/2014 Hu et al.
2015/0061952 A1 3/2015 Chiang et al.

(56) References Cited

U.S. PATENT DOCUMENTS

FOREIGN PATENT DOCUMENTS

| | | | |
|---|---|---|---|
| CN | 102684722 | | 9/2012 |
| EP | 0892459 | | 1/1999 |
| EP | 1146590 | | 10/2001 |
| EP | 1168496 | | 1/2002 |
| EP | 1363360 | | 11/2003 |
| EP | 1387435 | | 2/2004 |
| EP | 1501154 | | 4/2007 |
| EP | 2178167 | | 4/2010 |
| EP | 2182577 | | 5/2010 |
| EP | 2234207 | | 9/2010 |
| EP | 2328233 | | 1/2011 |
| EP | 2405534 | | 1/2012 |
| EP | 2528165 | | 11/2012 |
| JP | 09093029 | | 4/1997 |
| JP | 2000332530 | | 11/2000 |
| JP | 2005159813 | | 6/2005 |
| JP | 2005167730 | | 6/2005 |
| KR | 10-2012-0102516 | A | 9/2012 |
| WO | 2007012697 | | 2/2001 |
| WO | 01/29927 | | 4/2001 |
| WO | 200199230 | | 12/2001 |
| WO | 2002054534 | | 7/2002 |
| WO | 2006114771 | | 11/2006 |
| WO | 2011050845 | | 5/2011 |
| WO | 2011158057 | | 12/2011 |
| WO | 2012121865 | A1 | 9/2012 |

* cited by examiner

TUNABLE ANTENNA WITH SLOT-BASED PARASITIC ELEMENT

This application is a continuation of U.S. patent application Ser. No. 13/846,471, filed Mar. 18, 2013. This application claims the benefit of and claims priority to U.S. patent application Ser. No. 13/846,471, filed Mar. 18, 2013, which is hereby incorporated by reference herein in its entirety.

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

Electronic devices may be provided that contain wireless communications circuitry. The wireless communications circuitry may include radio-frequency transceiver circuitry and antenna structures. The antenna structures may form a dual arm inverted-F antenna. The transceiver circuitry may be coupled to the dual arm inverted-F antenna by a transmission line.

The antenna may have a dual arm inverted-F antenna resonating element formed from portions of a peripheral conductive electronic device housing structure and may have an antenna ground that is separated from the antenna resonating element by a gap. A short circuit path may bridge the gap. An antenna feed may be coupled across the gap in parallel with the short circuit path.

Low band tuning may be provided using an adjustable inductor that bridges the gap. The adjustable inductor may include a series of fixed inductors and switching circuitry that is configured to tune the antenna by switching a selected one of the fixed inductors into use.

The antenna may have a slot-based parasitic antenna resonating element with a slot that is formed between portions of the peripheral conductive electronic device housing member and the antenna ground. An adjustable capacitor may bridge the slot to provide high band tuning.

Further features of the invention, its nature and various advantages will be more apparent from the accompanying drawings and the following detailed description of the preferred embodiments.

DETAILED DESCRIPTION

Figure 1:
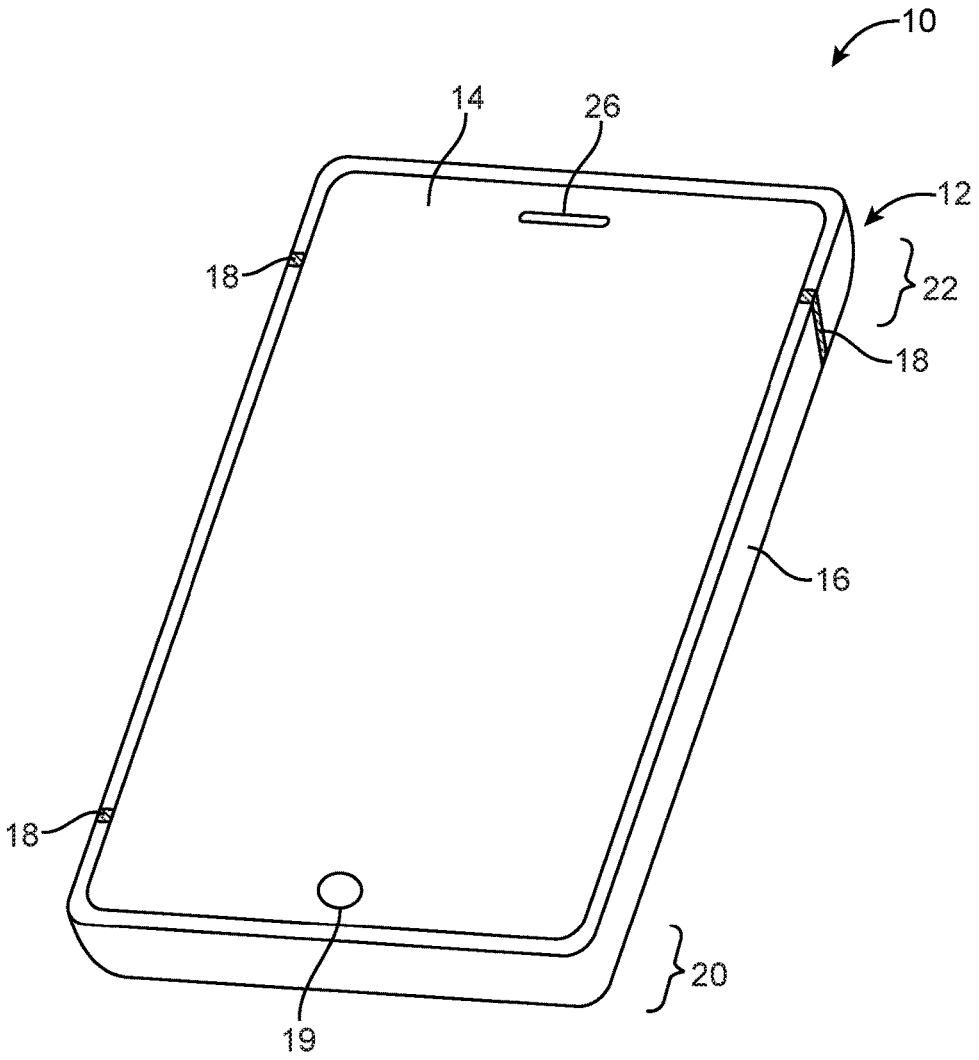
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A cover glass layer may cover the surface of display 14. Buttons such as button 19 may pass through openings in the cover glass. The cover glass may also have other openings such as an opening for speaker port 26.

Housing 12 may include peripheral housing structures such as structures 16. Structures 16 may run around the periphery of device 10 and display 14. In configurations in which device 10 and display 14 have a rectangular shape, structures 16 may be implemented using a peripheral housing member have a rectangular ring shape (as an example). Peripheral structures 16 or part of peripheral structures 16 may serve as a bezel for display 14 (e.g., a cosmetic trim that surrounds all four sides of display 14 and/or helps hold display 14 to device 10). Peripheral structures 16 may also, if desired, form sidewall structures for device 10 (e.g., by forming a metal band with vertical sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g., in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive housing structures 16 and opposing conductive structures such as conductive housing midplate or rear housing wall structures, a conductive ground plane associated with a printed circuit board, and conductive electrical components in device 10). These openings, which may sometimes be referred to as gaps, may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
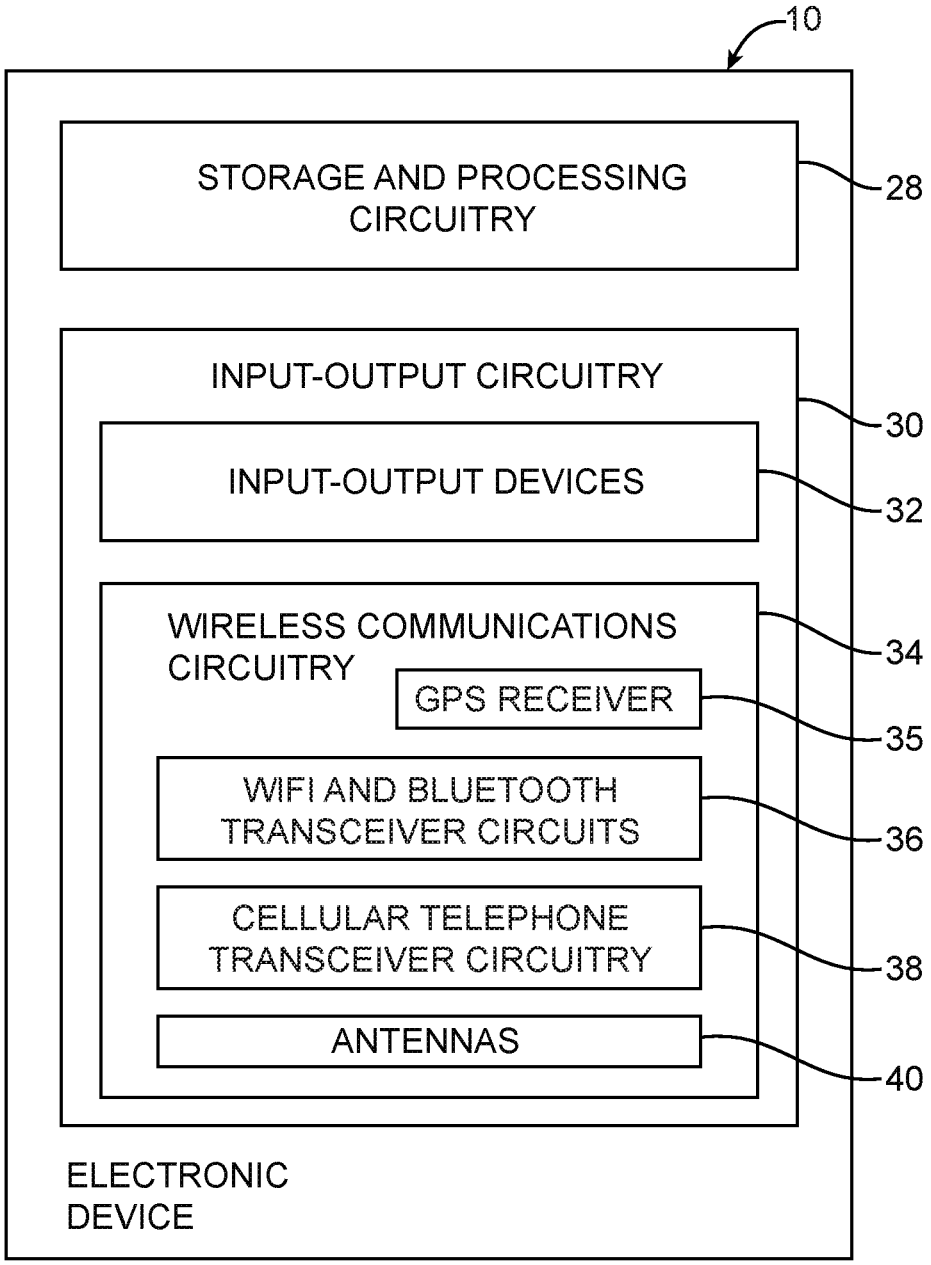
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc. In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Wireless local area network transceiver circuitry such as transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, etc. Near field communications may also be supported (e.g., at 13.56 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from loop antenna structures, patch antenna structures, inverted-F antenna structures, dual arm inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link. Antenna structures in device 10 such as one or more of antennas 40 may be provided with one or more antenna feeds, fixed and/or adjustable components, and optional parasitic antenna resonating elements so that the antenna structures cover desired communications bands.

Figure 3:
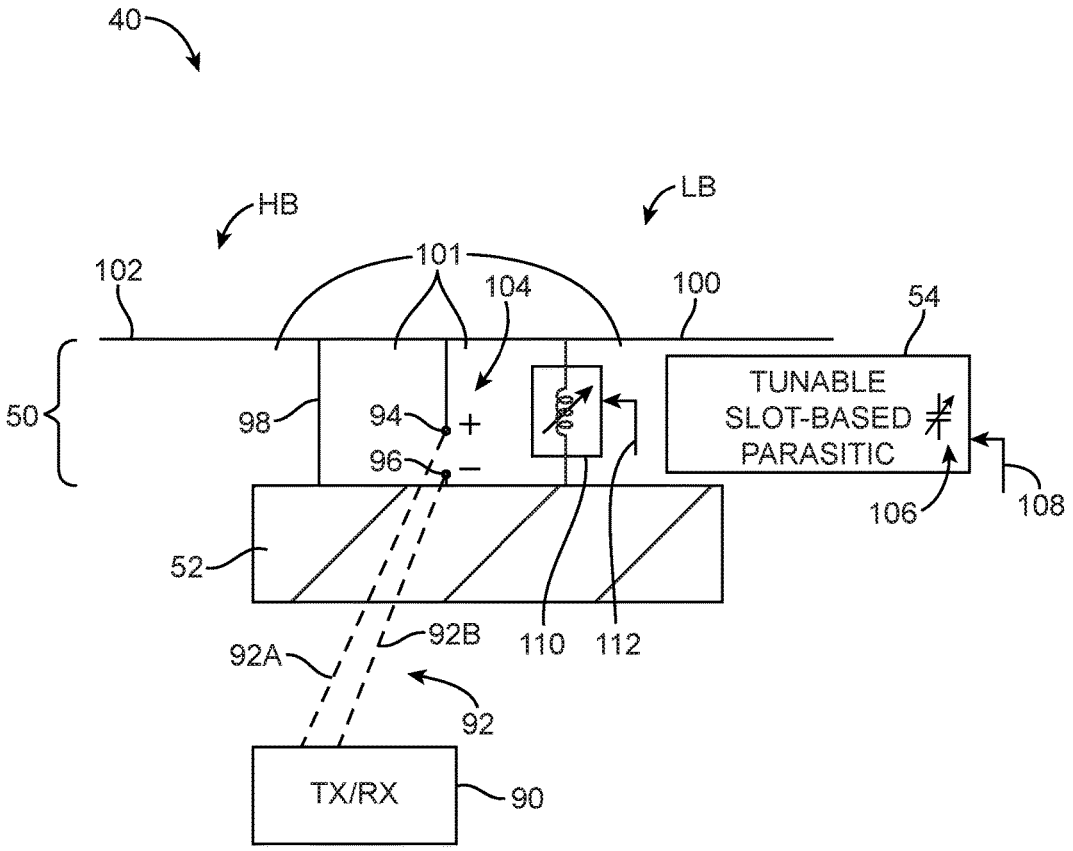
FIG. 3 is a diagram of an illustrative tunable antenna in accordance with an embodiment of the present invention.

An illustrative antenna of the type that may be used in device 10 (e.g., in region 20 and/or region 22) is shown in FIG. 3. The illustrative antenna of FIG. 3 uses a design of the type that is sometimes referred to as a dual arm inverted-F antenna or T antenna. As shown in FIG. 3, antenna 40 may have conductive antenna structures such as dual arm inverted-F antenna resonating element 50, optional parasitic antenna resonating element 54, and antenna ground 52. The conductive structures that form antenna resonating element 50, parasitic antenna resonating element 54, and antenna ground 52 may be formed from parts of conductive housing structures, from parts of electrical device components in device 10, from printed circuit board traces, from strips of conductor such as strips of wire and metal foil, or other conductive materials.

As shown in FIG. 3, transceiver circuitry 90 may be coupled to antenna 40 using transmission line structures such as transmission line 92. Transmission line 92 may have positive signal path 92A and ground signal path 92B. Paths 92A and 92B may be formed from metal traces on rigid printed circuit boards, may be formed from metal traces on flexible printed circuits, may be formed on dielectric support structures such as plastic, glass, and ceramic members, may be formed as part of a cable, etc. Transmission line 92 may be formed using one or more microstrip transmission lines, stripline transmission lines, edge coupled microstrip transmission lines, edge coupled stripline transmission lines, coaxial cables, or other suitable transmission line structures. Circuits such as impedance mating circuits, filters, switches, duplexers, diplexers, and other circuitry may, if desired, be interposed in transmission line path 92.

Transmission line 92 may be coupled to an antenna feed formed from antenna feed terminals such as positive antenna feed terminal 94 and ground antenna feed terminal 96. Antenna resonating element 50 may include a short circuit branch such as branch 98 that couples resonating element arm structures such as arms 100 and 102 to antenna ground 52. Dielectric gap 101 separates arms 100 and 102 from antenna ground 52. Antenna ground 52 may be formed from housing structures such as a metal midplate member, printed circuit traces, metal portions of electronic components, or other conductive ground structures. Gap 101 may be formed by air, plastic, and other dielectric materials. Feed path 104 contains the antenna feed formed from feed terminals 94 and 96 and is coupled between the resonating element arm structures and antenna ground 52 in parallel with short circuit path 98. Resonating element arms 100 and 102 may have one or more bends. The illustrative arrangement of FIG. 3 in which arms 100 and 102 run parallel to ground 52 is merely illustrative.

Low-band arm 100 may allow antenna 40 to exhibit an antenna resonance at low band (LB) frequencies (e.g., 700 MHz to 960 MHz or other suitable frequencies). High-band arm 102 may allow antenna 40 to exhibit one or more antenna resonances at high band (HB) frequencies (e.g., resonances at frequencies between 960 MHz to 2700 MHz or other suitable frequencies).

If desired, antenna 40 may include optional parasitic antenna resonating elements such as parasitic antenna resonating element 54. Parasitic antenna resonating element 54 is coupled to antenna resonating element 50 by near-field electromagnetic coupling and is used to modify the frequency response of antenna 40 so that antenna 40 operates at desired frequencies.

In the example of FIG. 3, parasitic antenna resonating element 54 is based on a slot antenna resonating element structure. Slot-type resonating element structures may include open slot structures (i.e., slots with one open end and one closed end) and closed slot structures (i.e., slots that are completely surrounded by metal). Slots for a slot-based parasitic antenna resonating element may be formed between opposing metal structures in antenna resonating element 50 and/or antenna ground 52. Plastic, air, or other dielectric may fill the interior of a slot. Slots are typically elongated (i.e., their lengths are substantially longer than their widths). Metal surrounds the periphery of the slot. In an open slot, one of the ends of the slot is open to surrounding dielectric.

To provide antenna 40 with tuning capabilities, antenna 40 may include adjustable circuitry. The adjustable circuitry may form part of antenna resonating element 50, optional parasitic elements such as parasitic antenna resonating element 54, or the structures of antenna ground 52.

As shown in FIG. 3, for example, parasitic antenna resonating element 54 may be a tunable parasitic resonating element that includes adjustable circuitry such as adjustable capacitor 106. The adjustable circuitry of tunable slot-based parasitic antenna resonating element 54 such as adjustable capacitor 106 may be tuned using control signals from control circuitry 28 (FIG. 2). Control signals may from control circuitry 28 may, for example, be provided to tunable slot-based parasitic antenna resonating element using control input path 108 to adjust the capacitance exhibited by adjustable capacitor 106. By selecting a desired capacitance value for capacitor 106 using control signals on path 108, antenna 40 can be tuned to cover operating frequencies of interest.

If desired, the adjustable circuitry of antenna 40 may include one or more adjustable circuits that are coupled to antenna resonating element structures 50 such as arms 102 and 100 in antenna resonating element 50. As shown in FIG. 3, for example, adjustable inductor 110 may be coupled between antenna resonating element arm structures in antenna 40 such as arm 100 (or arm 102) and antenna ground 52 (i.e., inductor 110 may bridge gap 101). Adjustable inductor 110 may exhibit an inductance value that is adjusted in response to control signals provided to control input 112 of adjustable inductor 110 from control circuitry 28.

During operation of device 10, control circuitry such as storage and processing circuitry 28 of FIG. 2 may make antenna adjustments by providing control signals to adjustable components such as adjustable inductors, adjustable capacitors, adjustable resistors, switches, switches in adjustable inductors, adjustable capacitors, and adjustable resistors, adjustable components such as variable inductors, varactors, and variable resistors, adjustable circuits that include combinations of two or more of these components and/or fixed inductors, capacitors, and resistors, or by providing control signals to other adjustable circuitry. Antenna frequency response adjustments may be made in real time in response to information identifying which communications bands are active, in response to feedback related to signal quality or other performance metrics, sensor information, or other information.

Figure 4:
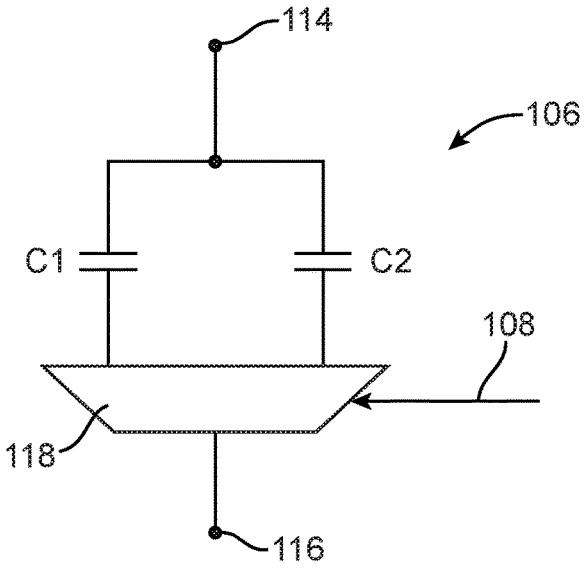
FIG. 4 is a diagram of an illustrative adjustable capacitor of the type that may be used in tuning an antenna in an electronic device in accordance with an embodiment of the present invention.

FIG. 4 is a schematic diagram of an illustrative adjustable capacitor circuit. Adjustable capacitor 106 of FIG. 4 produces an adjustable amount of capacitance between terminals 114 and 116 in response to control signals provided to input path 108. Switching circuitry 118 has two terminals coupled respectively to capacitors C1 and C2 and has another terminal coupled to terminal 116 of adjustable capacitor 106. Capacitor C1 is coupled between terminal 114 and one of the terminals of switching circuitry 118. Capacitor C2 is coupled between terminal 114 and the other terminal of switching circuitry 118 in parallel with capacitor C1. By controlling the value of the control signals supplied to control input 108, switching circuitry 118 may be configured to produce a desired capacitance value. For example, switching circuitry 118 may be configured to switch capacitor C1 into use or may be configured to switch capacitor C2 into use.

If desired, switching circuitry 118 may include one or more switches or other switching resources that selectively decouple capacitors C1 and C2 (e.g., by forming an open circuit so that the path between terminals 114 and 116 is an open circuit and both capacitors are switched out of use). Switching circuitry 118 may also be configured (if desired) so that both capacitors C1 and C2 can be simultaneously switched into use. Other types of switching circuitry 118 such as switching circuitry that exhibits fewer switching states or more switching states may be used if desired. Adjustable capacitors such as adjustable capacitor 106 may also be implemented using variable capacitor devices (sometimes referred to as varactors). The configuration of FIG. 4 is merely illustrative.

Figure 5:
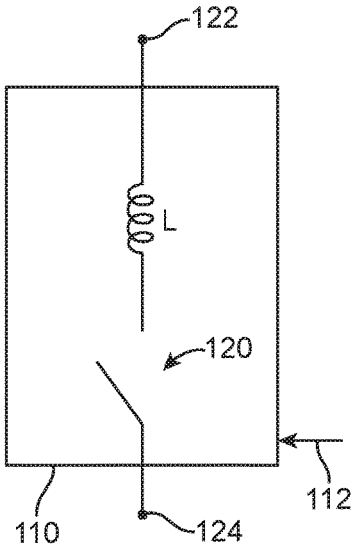
FIG. 5 is a diagram of an illustrative adjustable single-element inductor that may be used in tuning an antenna in an electronic device in accordance with an embodiment of the present invention.

FIG. 5 is a schematic diagram of adjustable inductor circuitry 110. In the FIG. 5 example, adjustable indictor circuitry 110 can be adjusted to produce different amounts of inductance between terminals 112 and 124. Switch 120 is controlled by control signals on control input 112. When switch 120 is placed in a closed state, inductor L is switched into use and adjustable inductor 110 exhibits an inductance L between terminals 122 and 124. When switch 120 is placed in an open state, inductor L is switched out of use and adjustable inductor 110 exhibits an essentially infinite amount of inductance between terminals 122 and 124.

Figure 6:
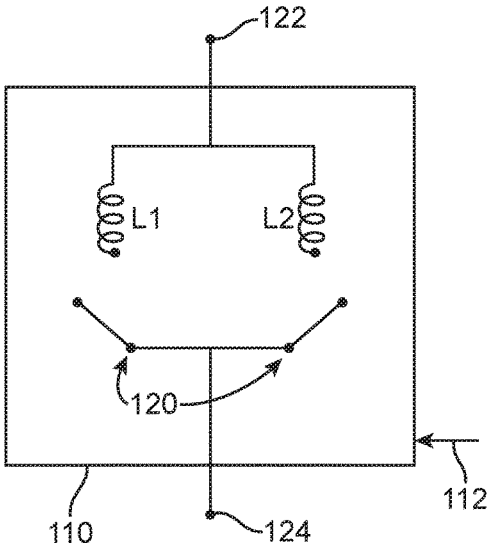
FIG. 6 is a diagram of an illustrative adjustable multi-element inductor in accordance with an embodiment of the present invention.

FIG. 6 is a schematic diagram of adjustable inductor circuitry 110 in a configuration in which multiple inductors are used in providing an adjustable amount of inductance. Adjustable inductor circuitry 110 of FIG. 6 can be adjusted to produce different amounts of inductance between terminals 112 and 124 by controlling the state of switching circuitry such as switch 120 (e.g., a single pole double throw switch) using control signals on control input 112. For example, control signals on path 112 may be used to switch inductor L1 into use between terminals 122 and 124 while switching inductor L2 out of use, may be used to switch inductor L2 into use between terminals 122 and 124 while switching inductor L1 out of use, may be used to switch both inductors L1 and L2 into use in parallel between terminals 122 and 124, or may be used to switch both inductors L1 and L2 out of use. The switching circuitry arrangement of adjustable inductor 110 of FIG. 6 is therefore able to produce one or more different inductance values, two or more different inductance values, three or more different inductance values, or, if desired, four different inductance values (e.g., L1, L2, L1 and L2 in parallel, or infinite inductance when L1 and L2 are switched out of use simultaneously).

Figure 7:
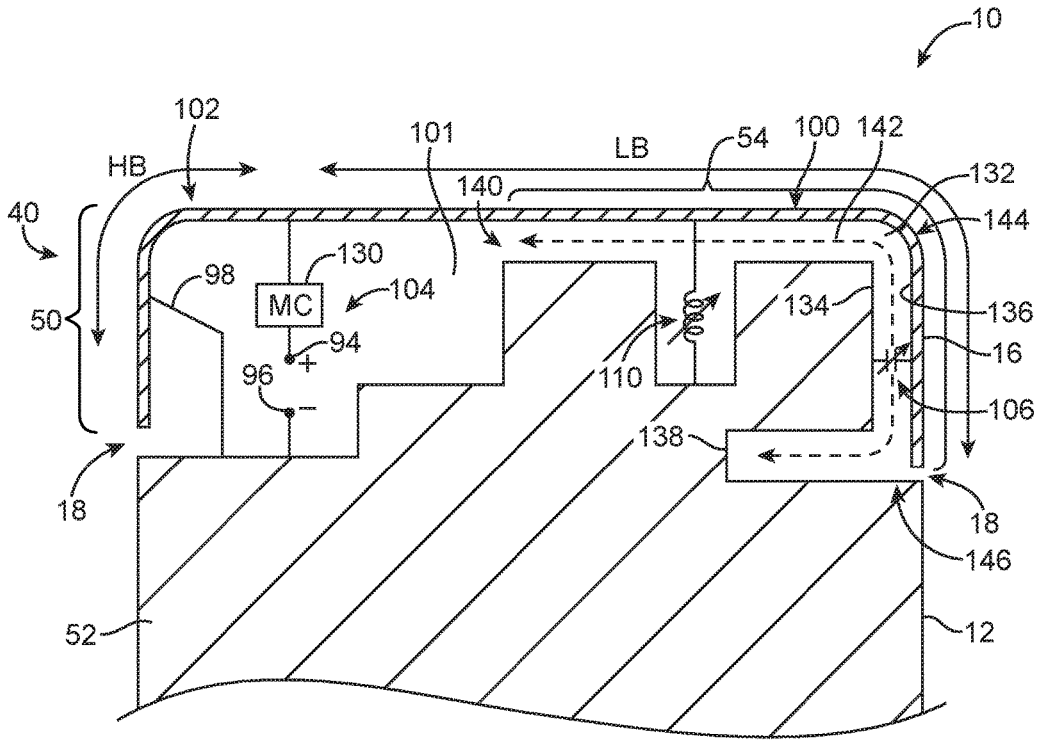
FIG. 7 is a diagram of an illustrative tunable electronic device antenna having an antenna resonating element that is formed from a portion of a peripheral conductive housing member and having a slot-based parasitic resonating element and tuning capabilities provided by adjustable inductor and adjustable capacitor circuitry in accordance with an embodiment of the present invention.

FIG. 7 is a diagram of an illustrative antenna of the type that may be implemented using conductive housing structures in electronic device 10. As shown in FIG. 7, dual arm inverted-F antenna resonating element 50 may be formed from portions of peripheral conductive housing structures 16. In particular, resonating element arm portion 102 for producing an antenna response in a high band (HB) frequency range and resonating element arm portion 100 for producing an antenna response in a low band (LB) frequency range may be formed from respective portions of peripheral conductive housing structures 16. Antenna ground 52 may be formed from sheet metal (e.g., one or more housing midplate members and/or a rear housing wall in housing 12), may be formed from portions of printed circuits, may be formed from conductive device components, or may be formed from other metal portions of device 10.

Antenna 40 may be fed by an antenna feed coupled in feed path 104. Feed path 104 may include an antenna feed formed from antenna feed terminals such as positive antenna feed terminal 94 and ground antenna feed terminal 96. Transmission line 92 (FIG. 3) may have a positive signal line coupled to terminal 94 and a ground signal line coupled to terminal 96. Impedance matching circuits such as matching circuit 130 and other circuitry (e.g., filters, switches, etc.) may be incorporated into feed path 104 or transmission line 92 if desired).

Slot-based parasitic antenna resonating element 54 is formed from slot 132. Slot 132 is surrounded by conductive structures such as metal housing structures 16 and other housing structures 12 (e.g., metal parts that form antenna ground 52), printed circuit traces, and electrical components and is filled with dielectric (e.g., air, plastic, glass, and/or other dielectric materials). Inner edge 134 of slot 132 may, for example, be formed from portions of antenna ground 52. Outer edge 136 of slot 132 may be formed from portions of peripheral conductive housing structures 16 (e.g., portions of resonating element arm 100).

As shown in FIG. 7, slot 132 has an elongated shape in which its width (i.e., the distance between edges 134 and 136) is substantially less than its length. Dashed line 142 shows how slot 132 extends from closed slot end 138 where slot 132 is bordered by conductive portions of antenna ground 52 to open slot end 140 where slot 132 is open to surrounding dielectric. With this type of configuration, slot 132 is characterized by bend 144 where slot 132 wraps around corner 144 of device 10 and is characterized by bend 146 where slot 132 departs from the periphery of device 10 and extends between opposing edges of antenna ground 52 towards closed end 138.

The length of slot 132, which affects the resonant frequency associated with slot 132, may be about 1-5 cm (as examples). With one suitable arrangement, the length of slot 132 is selected to create a resonant peak for slot 132 at about 3.5 GHz. This peak is located at a higher frequency range than typically desired for wireless communications in device 10. However, in the presence of adjustable capacitor 106 bridging slot 132 between peripheral conductive housing structures 16 and antenna ground 52, the resonant peak associated with parasitic resonating element slot 132 is shifted from 3.5 GHz to lower frequencies (e.g., frequencies in the range of about 2300 MHz to 2700 MHz). Adjustable capacitor 106 can be adjusted to tune the resonant frequency of the slot-based parasitic resonating element so that antenna 40 covers all frequencies of interest in the vicinity of the shifted resonance from slot-based parasitic antenna resonating element 54. Adjustable inductor 110 affects primarily low band performance for antenna 40 and can be adjusted to ensure that antenna 40 covers all low band frequencies of interest.

The presence of slot-based parasitic antenna resonating element 54 may help spatially distribute radio-frequency energy across the entire width of device 10 during operation of device 10 at high band frequencies. Spatially distributing radio-frequency signals in this way may help ensure that device 10 complies with regulatory limits on emitted radiation levels. In the absence of element 54, emitted energy at high frequencies may be concentrated in the vicinity of high band resonating element arm 102. In the presence of slot-based parasitic antenna resonating element 54, energy tends to be concentrated near arm 102 at lower high band frequencies and at element 54 at higher high band frequencies, so that emitted energy is distributed across the width of device 10 when averaged over high band frequencies.

Figure 8:
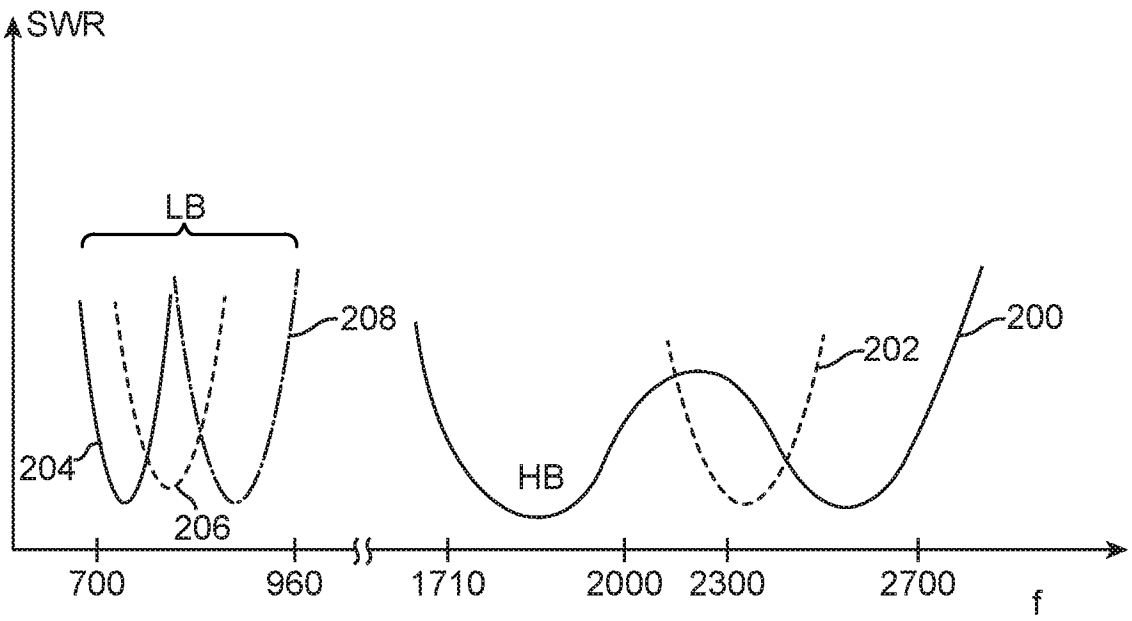
FIG. 8 is a graph of antenna performance as a function of frequency for a tunable antenna of the type shown in FIG. 7 in accordance with an embodiment of the present invention.

FIG. 8 is a graph in which antenna performance (i.e., standing wave ratio SWR) has been plotted as a function of operating frequency f. As shown in FIG. 8, antenna 40 may exhibit resonance 200. Slot-based parasitic antenna resonating element 54 may produce a resonant contribution at a relatively high frequency (e.g. 3.5 GHz). When adjustable capacitor 106 bridges slot 54 to couple edge 134 of antenna ground 52 to arm 100 (i.e., when arm 100 is coupled to ground 52 by adjustable capacitor 106), the resonance from slot-based parasitic antenna resonating element 54 may be shifted to the position shown in FIG. 8 (e.g., a position such as position 200 that covers frequencies such as frequencies from 2500 MHz to 2700 MHz for supporting operations in communications bands such as Long Term Evolution (LTE) band 38). In this position, capacitor 106 may exhibit a first capacitance (e.g., a capacitance C1 of 0.6 pF).

When it is desired to operate at lower frequencies such as frequencies associated with resonant peak position 202 of FIG. 8 (e.g., frequencies such as frequencies from 2300 MHz to 2500 MHz to cover communications bands such as LTE band 40), adjustable capacitor 106 may be adjusted to exhibit a second capacitance (e.g., a capacitance C2 of 0.8 pF). When capacitor 106 is adjusted to produce a capacitance of 0.8 pF (in this example), resonant peak 200 shifts to the position of resonant peak 202. Adjustable capacitor 106 therefore provides sufficient tuning to allow the slot-based parasitic antenna resonating element resonance from slot 54 to cover a range of frequencies from about 2300 MHz to about 2700 MHz (in this example).

High band resonance HB (e.g., frequencies from about 1710 MHz to 2000 MHz) may be covered by an antenna resonance contribution produced by high band arm 102 of antenna 40. Low band arm 100 may produce a resonance that is used in covering low band frequencies LB. Adjustable inductor 110 is coupled across gap 101 between low band resonating element arm 100 and antenna ground 52. The value of inductance produced by an adjustable inductor that bridges gap 101 such as adjustable inductor 110 is used in tuning antenna 40 in low band LB.

In the illustrative arrangement of FIG. 8, inductor 110 is being adjusted between three different states each associated with a different corresponding inductance value. Inductor 110 may be, for example, an adjustable inductor of the type shown in FIG. 6 in which L1 has a value of 12 nH and in which L2 has a value of 51 nH.

When switching circuitry 120 of FIG. 6 is placed in a position in which L1 and L2 are both switched into use in parallel, the inductance of inductor 110 will be about 10 nH. In this situation, antenna 40 (e.g., arm 100) will produce resonance peak 208. When switching circuitry 120 of FIG. 6 is placed in a configuration in which L2 is switched into use and L1 is switched out of use, inductor 110 will exhibit an inductance of about 51 nH and antenna 40 will produce resonance peak 206 (which is peak 208 shifted to a lower frequency). Switching circuitry 120 of FIG. 6 can also be adjusted so that both inductors L1 and L2 are switched out of use. In this situation, the inductance of inductor 110 will be high (effectively infinite) and antenna 40 will exhibit resonance peak 204 (which is peak 206 shifted to a lower frequency). The ability to tune the antenna resonance exhibited by low band antenna resonating element arm 100 allows antenna 40 to cover all desired frequencies of interested in low band LB (e.g., all frequencies of interest from about 700 MHz to about 960 MHz, as an example).

Figure 9:
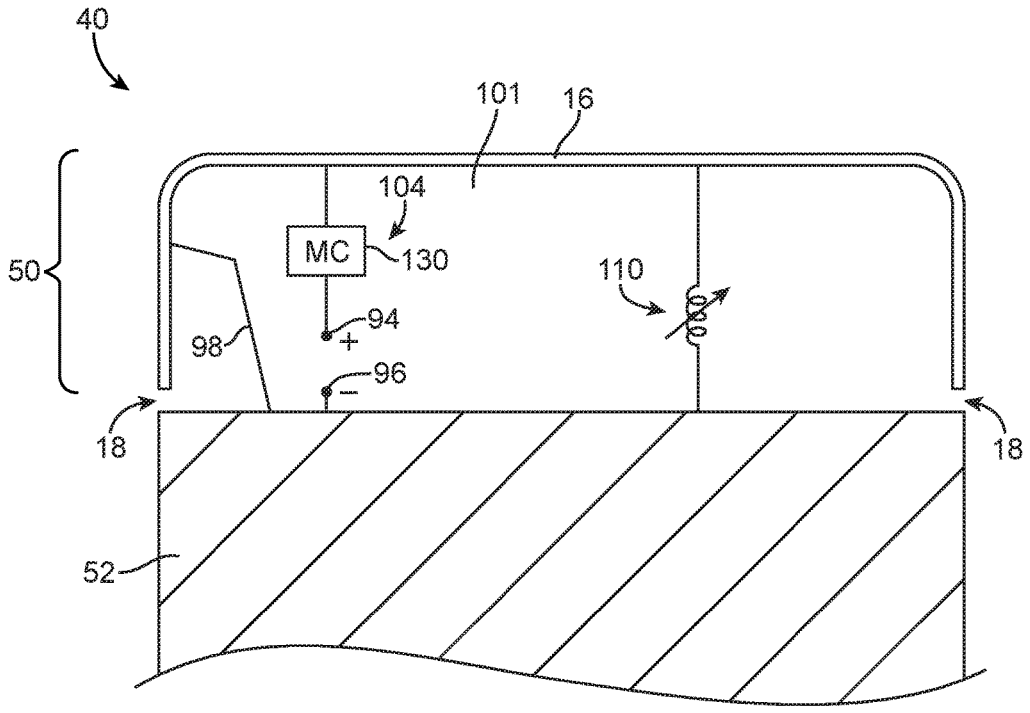
FIG. 9 is a diagram of an illustrative tunable electronic device antenna having an antenna resonating element that is formed from a portion of a peripheral conductive housing member and having tuning capabilities provided by an adjustable inductor in accordance with an embodiment of the present invention.

In situations in which it is not desired to cover communications frequencies in the range of 2300 to 2700 MHz, slot-based parasitic antenna resonating element 54 may be omitted from antenna 40, as shown in FIG. 9. In this configuration, antenna 40 may exhibit the resonances of low band LB and high band HB that are shown in FIG. 8 without exhibiting resonances 200 and 202 associated with slot-based parasitic antenna resonating element 54.

The foregoing is merely illustrative of the principles of this invention and various modifications can be made by those skilled in the art without departing from the scope and spirit of the invention.

What is claimed is:

1. An electronic device, comprising:

a housing having peripheral conductive structures;

first and second dielectric gaps formed on opposing sides of the electronic device that divide the peripheral conductive housing structures;

an antenna resonating element formed from a segment of the peripheral conductive structures located between the first and second dielectric gaps;

an antenna ground;

an antenna feed having a first antenna feed terminal coupled to the segment and a second antenna feed terminal coupled to the antenna ground;

a parasitic antenna resonating element formed between the segment of the peripheral conductive structures and the antenna ground; and an adjustable component that is coupled to the segment and the antenna ground and that overlaps the parasitic antenna resonating element.

2. The electronic device defined in claim 1, wherein the parasitic antenna resonating element resonates in a first frequency band, the antenna resonating element comprising:

a first arm that resonates in a second frequency band that is lower than the first frequency band; and a second arm that resonates in a third frequency band that is lower than the second frequency band.

3. The electronic device defined in claim 2, wherein the parasitic antenna resonating element is formed between the second arm of the antenna resonating element and the antenna ground.

4. The electronic device defined in claim 3, wherein the adjustable component is coupled to the second arm of the antenna resonating element.

5. The electronic device defined in claim 1, wherein the parasitic antenna resonating element is located between the antenna feed and the first dielectric gap and the antenna feed is located between the parasitic antenna resonating element and the second dielectric gap.

6. The electronic device defined in claim 1, further comprising:

an additional adjustable component coupled to the segment of the peripheral conductive structures and the antenna ground.

7. The electronic device defined in claim 1, wherein the adjustable component comprises an adjustable inductor.

8. The electronic device defined in claim 1, wherein the parasitic antenna resonating element has a first portion that extends along a first longitudinal axis and a second portion that extends from an end of the first portion and along a second longitudinal axis that is substantially perpendicular to the first longitudinal axis.

9. The electronic device defined in claim 8, wherein the parasitic antenna resonating element further comprises a third portion that extends along a third longitudinal axis that is substantially parallel to the first longitudinal axis.

10. An antenna, comprising:

an antenna resonating element formed from a metal electronic device housing structure that has a first arm that resonates in a first frequency band and a second arm that resonates in a second frequency band that is greater than the first frequency band;

an antenna ground that is separated from the antenna resonating element;

a parasitic antenna resonating element that resonates in a third frequency band that is greater than the second frequency band; and an adjustable component that is coupled to the first arm and the antenna ground, that bridges and overlaps the parasitic antenna resonating element, and that is configured to adjust the first frequency band in which the first arm resonates.

11. The antenna defined in claim 10, wherein the parasitic antenna resonating element has a first portion that extends along a first longitudinal axis and a second portion that extends along a second longitudinal axis that is substantially perpendicular to the first longitudinal axis.

12. The antenna defined in claim 10, wherein the parasitic antenna resonating element is interposed between the first arm and the antenna ground.

13. The antenna defined in claim 10, wherein the parasitic antenna resonating element comprises a slot that resonates in the third frequency band and the adjustable component bridges the slot.

14. An electronic device, comprising:

an antenna ground;

an antenna resonating element formed from a metal electronic device housing structure that extends across a width of the electronic device, wherein the antenna resonating element has a low band arm that resonates in a first frequency band and a high band arm that resonates in a second frequency band that is greater than the first frequency band;

an antenna feed having a first antenna feed terminal coupled to the antenna resonating element and a second antenna feed terminal coupled to the antenna ground; and a parasitic antenna resonating element formed between the low band arm and the antenna ground, wherein the parasitic antenna resonating element is indirectly fed by the antenna resonating element via near-field electromagnetic coupling.

15. The electronic device defined in claim 14, wherein the parasitic antenna resonating element resonates in a third frequency band that is greater than the second frequency band.

16. The electronic device defined in claim 14, wherein the parasitic antenna resonating element comprises a slot having a first edge defined by the antenna ground and an opposing second edge defined by the low band arm.

17. The electronic device defined in claim 14, wherein the electronic device has a length and a height, and the width is less than the length and greater than the height.

18. The electronic device defined in claim 14, wherein the parasitic antenna resonating element is indirectly fed by the low band arm.

19. The electronic device defined in claim 14, further comprising an adjustable component that is coupled to the low band arm and the antenna ground and that overlaps the parasitic antenna resonating element.

* * * * *